US009995116B2

(12) United States Patent
Flores Perez

(10) Patent No.: US 9,995,116 B2
(45) Date of Patent: Jun. 12, 2018

(54) DIRECTIONAL SCREEN, SYSTEM AND METHOD

(71) Applicant: Juan Carlos Flores Perez, The Woodlands, TX (US)

(72) Inventor: Juan Carlos Flores Perez, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 270 days.

(21) Appl. No.: 14/947,793

(22) Filed: Dec. 11, 2015

(65) Prior Publication Data

US 2017/0167232 A1 Jun. 15, 2017

(51) Int. Cl.
*E21B 43/08* (2006.01)

(52) U.S. Cl.
CPC ..... *E21B 43/08* (2013.01)

(58) Field of Classification Search
None
See application file for complete search history.

(56) References Cited

U.S. PATENT DOCUMENTS 1,744,329 A * 1/1930 Mraz ..... E06B 9/52 160/15
2,187,483 A * 1/1940 Baker ..... E21B 33/146 166/116
2,255,167 A * 9/1941 Hunn ..... E02F 3/9243 210/170.01
3,254,721 A * 6/1966 Smith ..... E21B 36/02 166/59
3,864,267 A * 2/1975 Nelems ..... B01D 35/00 210/474
4,084,636 A * 4/1978 Burge ..... E21B 4/02 166/66.5
4,247,397 A * 1/1981 Dobosi ..... B01D 29/05 210/162
6,164,361 A * 12/2000 Meyer ..... E06B 9/52 160/12
6,942,035 B2 * 9/2005 Sollesnes ..... E21B 27/00 166/301
8,113,968 B2 * 2/2012 Fittler ..... A63B 63/003 473/422
2002/0155010 A1 * 10/2002 Karp ..... B01L 3/502738 417/413.2
2015/0226041 A1 * 8/2015 Holderman ..... E21B 43/08 166/386

OTHER PUBLICATIONS

TRI-D Weave FacsPort brochure, Absolute Completion Technoloiges; www.ABSOLUTLETCT.com; 4 pages, website: http://www.absolutect.com/wp-content/uploads/2014/08/ACT_TriDFP14.01_141030_FIN_WEB.pdf?submissionGuid=2c4c2585-9e36-4d4a-a9fa-c2d3f2f4e774, Aug. 2014.

* cited by examiner

*Primary Examiner* — Shane Bomar
(74) *Attorney, Agent, or Firm* — Cantor Colburn LLP

(57) ABSTRACT

A directional screen includes a structure defining an opening; one or more first members attached at one end to the structure. The one or more first members configured to move between a first operational position and a second operational position. A method for treating a borehole.

19 Claims, 4 Drawing Sheets

DIRECTIONAL SCREEN, SYSTEM AND METHOD

BACKGROUND

In the downhole exploration and completion arts, many operations are performed that require treatment fluids to be injected in to a formation surrounding a borehole. Some of those fluids will contain entrained particulate matter. These fluids are generically known as slurry fluids and have a number of purposes including creating gravel packs, acting as fracture fluids that include proppants to maintain the fractures open to flow, etc. In operations using fluids of this nature, it is important for the particulates to get to the position where they are needed but it is undesirable for the particulates to flow back into the borehole and tubing string in the borehole after the treatment process is concluded.

Sand screens are known for excluding particulate matter from entering a production flow. They are also known for use with fracturing operations to prevent sand, gravel, (generically particulates) etc. injected into the formation or liberated from the formation from flowing back into the borehole. Present art screens are effective in preventing flow of particulates through the screens itself but sometimes, for example in a fracturing operation as noted above, it is necessary to inject the sand and through the tubing and then not allow the sand back into the tubing. This has been done in various ways all involving openings for sand injection that are then closed and screens for allowing a liquid component of the slurry or a borehole fluid to pass into the tubing string without allowing the sand to pass. Such systems are quite functional but are complicated and dimensionally long. The art would well receive alternatives that are less complicated and function well.

SUMMARY

A directional screen includes a structure defining an opening; one or more first members attached at one end to the structure, the one or more first members configured to move between a first operational position and a second operational position.

A method for treating a borehole includes disposing a tubing string with a directional screen as claimed in claim 1 in a borehole; injecting a treatment fluid through the tubing string and through the screen into a formation surrounding the borehole.

BRIEF DESCRIPTION OF DRAWINGS

The following descriptions should not be considered limiting in any way. With reference to the accompanying drawings, like elements are numbered alike.

DETAILED DESCRIPTION

Figure 1:
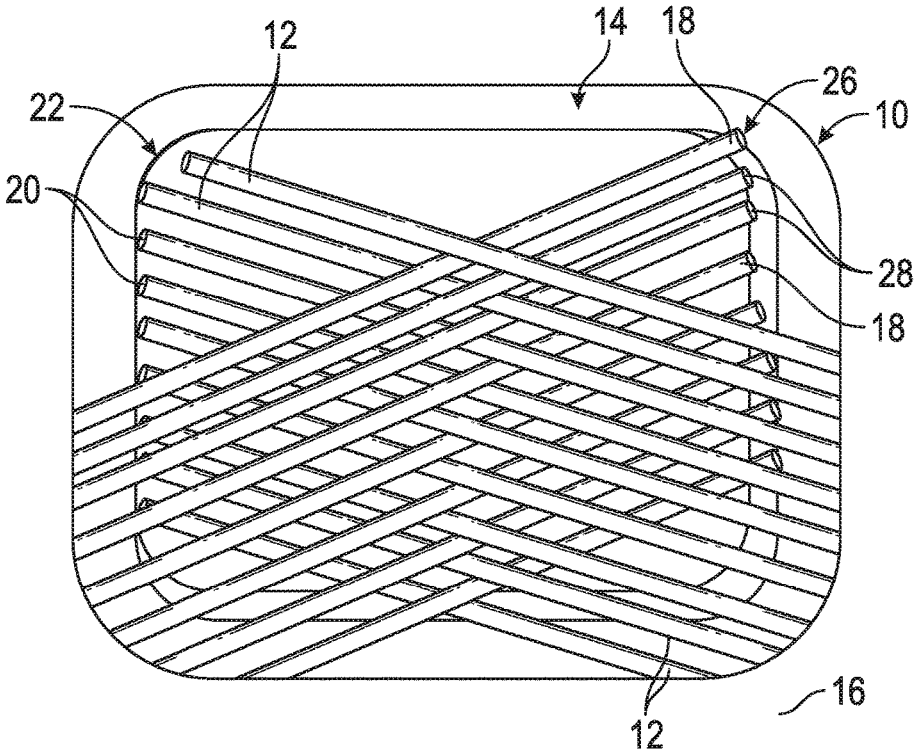
FIG. 1 is a schematic view of a directional screen as disclosed herein in a first operational position.
Figure 1A:
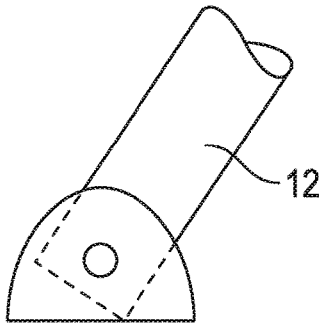
FIG. 1A is a schematic view of a hinge embodiment of the directional screen in FIG. 1.

Referring to FIG. 1, a screen 10 is illustrated having one or more first members 12 interlaced over an opening 14 in a tubular 16 with one or more second members 18. The one or more first members 12 are spaced regularly from one another and attached at one end 20 each to an edge 22 of the opening 14. The attachment may be fixed in some embodiments (adhesive, welding, etc.) and may have movement in some other embodiments for example such as a hinge schematically illustrated in an enlarged view in FIG. 1A. Where the attachment is fixed, operation of the screen between the first and second operational positions relies upon flexibility of the one or more members. In the case of the hinge of FIG. 1A, flexibility of the one or more members may still play a part in operation between the first and second operational positions but is less of a factor and can in some embodiments be nonexistent.

At an opposite edge 26 of the opening 14, the one or more second members 18 are regularly spaced from one another and attached at a respective one end 28.

Figure 3:
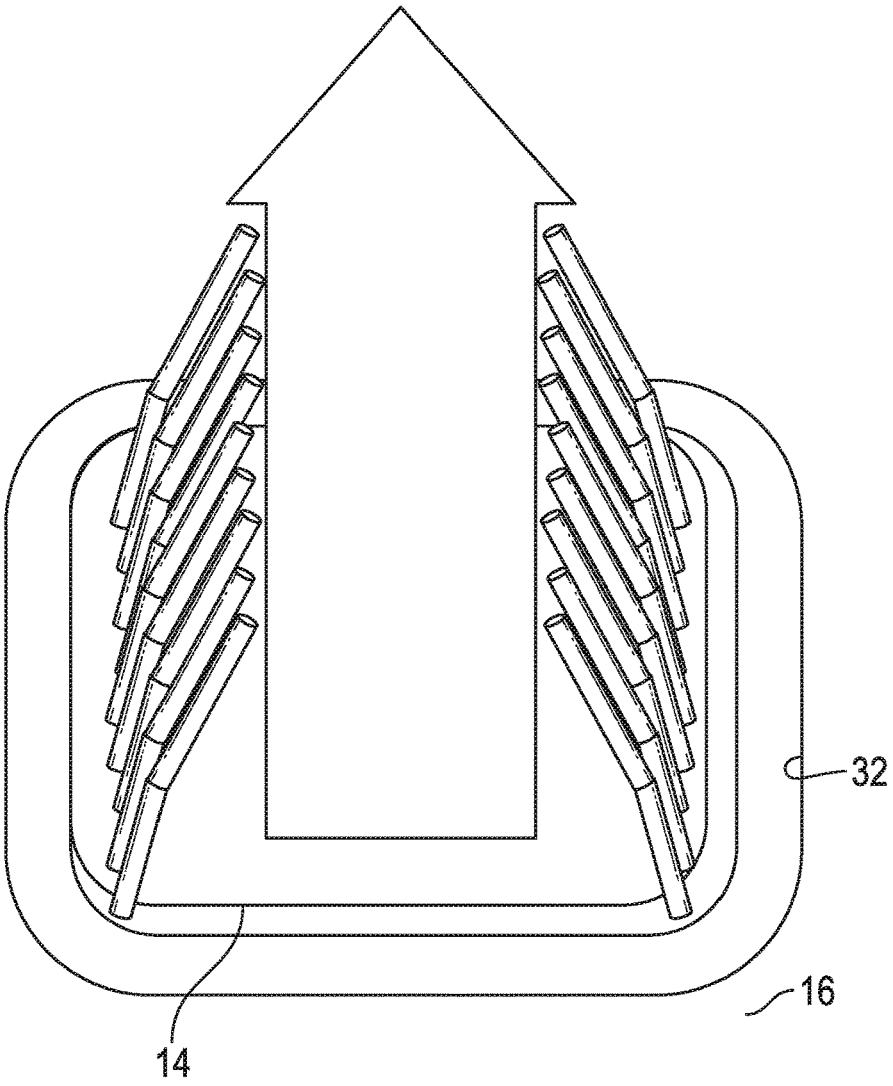
FIG. 3 is a schematic view of the embodiment of FIG. 1 in a second operational position.
Figure 4:
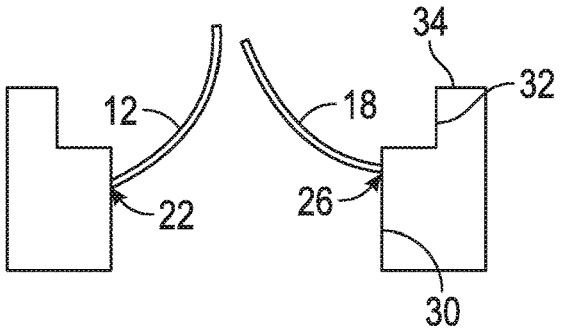
FIG. 4 is a view similar to FIG. 2 but with an embodiment of the screen in the second operational position.
Figure 5:
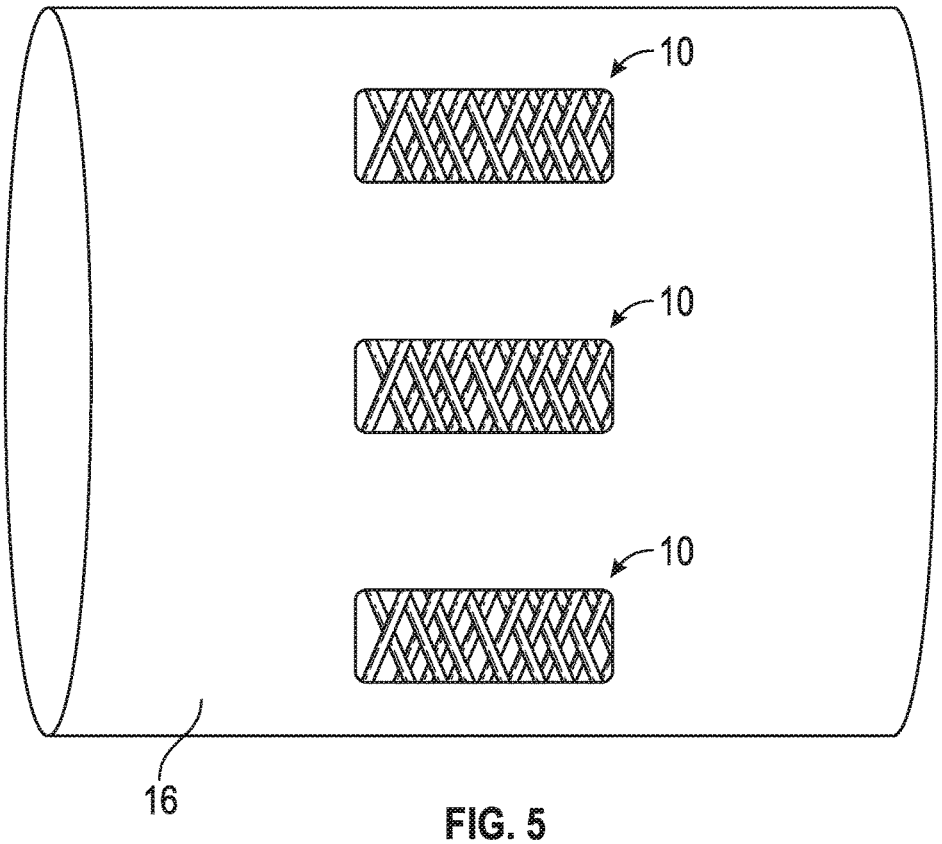
FIG. 5 is a side view of a portion of a tubular string bearing directional screens at disclosed herein.

FIG. 1 provides understanding of the effect of the interlaced one or more first members 12 and one or more second members 14. It is to be appreciated that the interlaced members form a screen such that fluid flowing from above the drawing on the sheet through the sheet would be filtered by the screen. Stated alternately, any entrained particles in the hypothetical flowing fluid that are larger than the mesh size produced by the screen illustrated in FIG. 1 would be left behind as the fluid flows from above the drawing to below the drawing (i.e. through the paper sheet upon which the drawing is set). Immediate reference to FIGS. 3 and 4, will make apparent that in the opposite direction of flow of fluid (i.e. from below the page to above the page) will not exclude particulates entrained in the fluid regardless of the mesh of the screen in FIG. 1 since the screen itself has opened (in one embodiment elastically deformed each member as in FIG. 4) to fluid flowing in that direction. This represents a significant benefit of this disclosure in that this function allows an operator to inject a slurry through a tubing string and out into a surrounding formation while excluding particulate flowing back into the string once the injection operation has been concluded. Such an operation facilitates proppant flow into the formation and then inhibits the flowback of that proppant. Using the embodiments hereof, a fracpack for example will have a longer valuable life. Of course, the embodiments hereof are not limited to flowing treatment fluids with particulate components but can also be used with other fluids.

With respect to the mesh size mentioned above, the size is in a range of 0.04 in to 0.4 in and is dictated by a cross sectional set of dimensions of each of the one or more members 12 and 18 and the proximity to one another in which they are attached to the edges of the opening.

It has also been determined that the dimensions between the edges 22 and 26 should be from 0.4 in to 2 in in order to enhance the interlacing and opening effects of the screen. Dimensions of the opening 14 other than between edges 22 and 26 may be selected based upon practicality and overall engineering of the tubing string system of which the directional screen is to be a part as these other dimensions do not impact the interlacing and opening feature of the screen.

Figure 2:
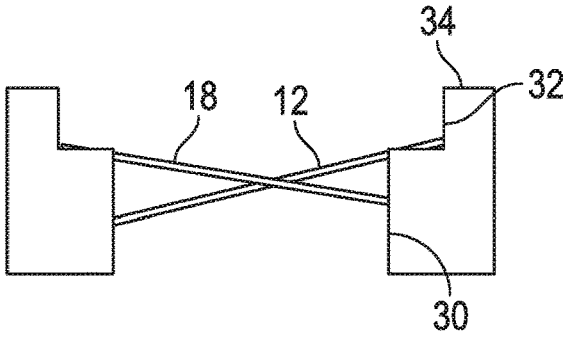
FIG. 2 is a cross sectional view of FIG. 1 illustrating one embodiment of an opening configuration and member placement.

Referring to FIG. 2, it will be noted that in an embodiment, the opening 14 is of a stepped configuration having an attachment area 30 and a resting area 32 for each of the members. This optional configuration provides protection to the members when running as they sit in the first operational position below an outer surface 34 of the tubing.

Figure 6:
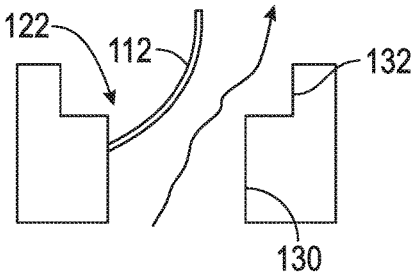
FIG. 6 is a cross sectional view similar to FIG. 2 but illustrating an alternate embodiment in a first operational position.
Figure 7:
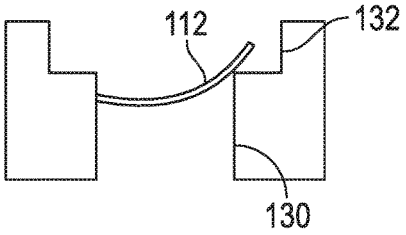
FIG. 7 is the embodiment of FIG. 6 in the second operational position.
Figure 8:
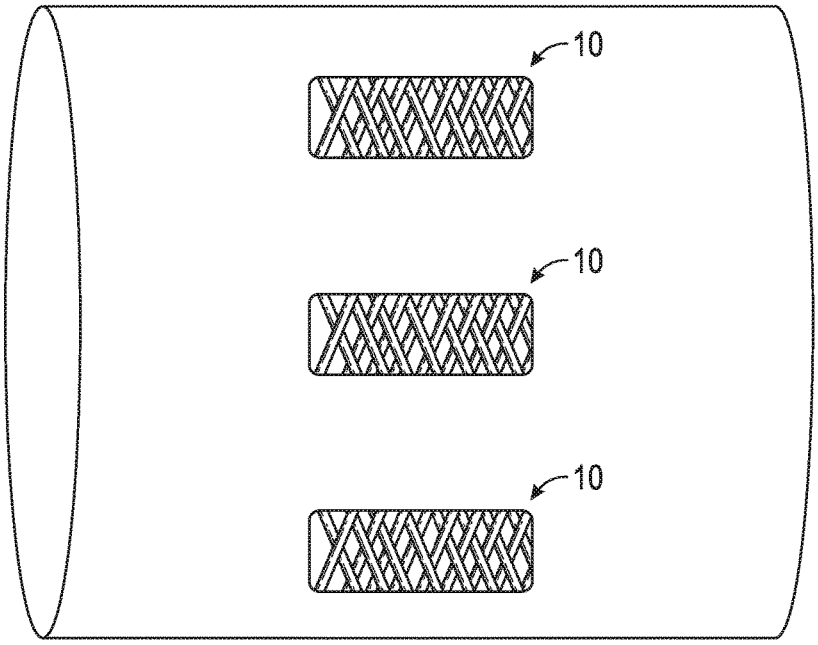
FIG. 8 is a side view of a portion of a tubular string bearing directional screens of the embodiment of FIGS. 6 and 7.

Referring to FIGS. 6-8, an alternate embodiment of the directional screen is illustrated. While in the foregoing discussion an interlacing of one or more members from opposing sides of an opening produced a directional screen, it is also contemplated herein that one or more members from only one side of an opening may be configured to provide a directional screen as well. In that many of the features of this embodiment closely resemble those of the embodiment of FIG. 1, one hundred series numerals otherwise identical to the numerals used above will identify the portions n the drawings. In this embodiment, one or more members 112 are attached to edge 122 as in the previous embodiment (including the FIG. 1A attachment). The one or more members themselves have the same composition and physical dimensions as do those discussed above as well. Significantly, this embodiment eliminates the one or more members that extend from an opposing edge as discussed above. The result is a screen having a larger mesh than the previous embodiment for the same dimension members with the same spacing as the FIG. 1 embodiment but by adjusting the member dimensions and their spacing relative to one another, a mesh of any desired size may be achieved in this embodiment as well. A potential advantage of this embodiment over the FIG. 1 embodiment is that there are no members to become entangled while the screen is transitioning to the second operational position from the first operational position.

Set forth below are some embodiments of the foregoing disclosure.

Embodiment 1

A directional screen comprising: a structure defining an opening; one or more first members attached at one end to the structure, the one or more first members configured to move between a first operational position and a second operational position.

Embodiment 2

The screen of Embodiment 1 further comprising: one or more second members attached at a respective one end to the structure and interlaced with the one or more first members in the first operational position and independent in the second operational position.

Embodiment 3

The screen of Embodiment 1 wherein the structure is a tubular housing.

Embodiment 4

The screen of Embodiment 1 wherein the one or more first members are elongated.

Embodiment 5

The screen of Embodiment 1 wherein the one or more first members when in the first operational position produce a screen having a mesh dictated by cross sectional dimensions of the one or more first members and a proximity of attachment of each adjacent one or more first members.

Embodiment 6

The screen of Embodiment 1 wherein the one or more first members are fixedly attached to the structure at the respective one end.

Embodiment 7

The screen of Embodiment 1 wherein the one or more first members are attached to the structure at opposing edges of the opening.

Embodiment 8

The screen of embodiment 7 wherein a dimension between the opposing edges is in a range from 0.4 to 2 inches.

Embodiment 9

The screen of Embodiment 1 wherein the opening includes a shouldered configuration receptive of non-attached ends of the one or more first members when in the first operational position.

Embodiment 10

The screen of Embodiment 1 wherein the first operational position screens a flow of sand through the opening, during use.

Embodiment 11

The screen of Embodiment 1 wherein the second operational position allows sand flow through the opening, during use.

Embodiment 12

The screen of Embodiment 2 wherein the one or more members are configured with a dimension along their own axes that is greater than a dimension of the opening measured between the attachments of the one or more first member and the one or more second members.

Embodiment 13

The screen of Embodiment 2 wherein the interlaced condition is one by one among the one or more first and one or more second members.

Embodiment 14

The screen of Embodiment 1 wherein the one or more first members are flexible elastically between the first operational position and the second operational position.

Embodiment 15

A treatment system comprising: a tubular string; and a directional screen of embodiment 1 disposed in the tubular string.

Embodiment 16

A method for treating a borehole comprising: disposing a tubing string with a directional screen of Embodiment 1 in a borehole; injecting a treatment fluid through the tubing string and through the screen into a formation surrounding the borehole.

Embodiment 17

The method of Embodiment 16 wherein the injecting includes urging the one or more first members to the second operational position with the treatment fluid.

Embodiment 18

The method of Embodiment 17 wherein the method further includes ceasing injection resulting in the one or more first members assuming the second operational position.

Embodiment 19

The method of Embodiment 16 wherein the treatment fluid is a sand slurry and the one or more first members in the second operational position exclude particulates from fluid flowing through the opening in one direction only.

Embodiment 20

The method of Embodiment 19 wherein the sand component of the slurry is excluded only during fluid flow direction returning to the tubing string after being injected into the formation.

Embodiment 21

A directional screen comprising: a structure defining an opening; one or more first members attached at one end to the structure; one or more second members attached at a respective one end to the structure and interlaced with the one or more first members in a first operational position and independent in a second operational position.

Embodiment 22

The screen of Embodiment 21 wherein the structure is a tubular housing.

Embodiment 23

The screen of Embodiment 21 wherein the one or more first members and the one or more second members are elongated.

Embodiment 24

The screen of Embodiment 21 wherein the one or more first members and one or more second members when in the first operational position produce a screen having a mesh dictated by cross sectional dimensions of the one or more first members and one or more second members and a proximity of attachment of each adjacent one or more first members and each adjacent one or more second members.

Embodiment 25

The screen of Embodiment 21 wherein the one or more first members and the one or more second members fixedly attached to the structure at the respective one end.

Embodiment 26

The screen of Embodiment 21 wherein the one or more first members and one or more second members are attached to the structure at opposing edges of the opening.

Embodiment 27

The screen of Embodiment 26 wherein a dimension between the opposing edges is in a range from 0.04 to 2 inches.

Embodiment 28

The screen of Embodiment 21 wherein the opening includes a shouldered configuration receptive of non-attached ends of the one or more first members and one or more second members when in the first operational position.

Embodiment 29

The screen of Embodiment 21 wherein the first operational position screens a flow of sand through the opening, during use.

Embodiment 30

The screen of Embodiment 21 wherein the second operational position allows sand flow through the opening, during use.

Embodiment 31

The screen of Embodiment 21 wherein the one or more members are configured with a dimension along their own axes that is greater than a dimension of the opening measured between the attachments of the one or more first member and the one or more second members.

Embodiment 32

The screen of Embodiment 21 wherein the interlaced condition is one by one among the one or more first and one or more second members.

Embodiment 33

The screen of Embodiment 21 wherein the one or more first members and one or more second members are flexible elastically between the first operational position and the second operational position.

Embodiment 34

A treatment system comprising: a tubular string; and a directional screen as claimed in claim 21 disposed in the tubular string.

Embodiment 35

A method for treating a borehole comprising: disposing a tubing string with a directional screen as claimed in claim 21 in a borehole; injecting a treatment fluid through the tubing string and through the screen into a formation surrounding the borehole.

Embodiment 36

The method of Embodiment 35 wherein the injecting includes urging the one or more first members and the one or more second members to the second operational position with the treatment fluid.

Embodiment 37

The method of Embodiment 36 wherein the method further includes ceasing injection resulting in the one or more first members and the one or more second members assuming the second operational position.

Embodiment 38

The method of Embodiment 35 wherein the treatment fluid is a sand slurry and the one or more first members and one or more second members in the second operational position exclude particulates from fluid flowing through the opening in one direction only.

Embodiment 39

The method of Embodiment 38 wherein the sand component of the slurry is excluded only during fluid flow direction returning to the tubing string after being injected into the formation.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

The invention claimed is:

1. A directional screen comprising:

a structure defining an opening;

one or more first members attached at one end to the structure, the one or more first members configured to move between a first operational position and a second operational position, the one or more first members when in the first operational position producing a screen having a mesh dictated by cross sectional dimensions of the one or more first members and a proximity of attachment of each adjacent one or more first members.

2. A directional screen comprising:

a structure defining an opening;

one or more first members attached at one end to the structure, the one or more first members configured to move between a first operational position and a second operational position; and one or more second members attached at a respective one end to the structure and interlaced with the one or more first members in the first operational position and independent in the second operational position.

3. The screen as claimed in claim 1 wherein the structure is a tubular housing.

4. The screen as claimed in claim 1 wherein the one or more first members are elongated.

5. The screen as claimed in claim 1 wherein the one or more first members are fixedly attached to the structure at the respective one end.

6. The screen as claimed in claim 1 wherein the one or more first members and one or more second members are attached to the structure at opposing edges of the opening.

7. The screen as claimed in claim 6 wherein a dimension between the opposing edges is in a range from 0.4 to 2 inches.

8. The screen as claimed in claim 1 wherein the opening includes a shouldered configuration receptive of non-attached ends of the one or more first members when in the first operational position.

9. The screen as claimed in claim 1 wherein the first operational position screens a flow of sand through the opening, during use.

10. The screen as claimed in claim 1 wherein the second operational position allows sand flow through the opening, during use.

11. The screen as claimed in claim 2 wherein the one or more first members are configured with a dimension along their own axes that is greater than a dimension of the opening measured between the attachments of the one or more first member and the one or more second members.

12. The screen as claimed in claim 2 wherein the interlaced condition is one by one among the one or more first and one or more second members.

13. The screen as claimed in claim 1 wherein the one or more first members are flexible elastically between the first operational position and the second operational position.

14. A treatment system comprising:

a tubular string; and a directional screen as claimed in claim 1 disposed in the tubular string.

15. A method for treating a borehole comprising:

disposing a tubing string with a directional screen as claimed in claim 1 in a borehole;

injecting a treatment fluid through the tubing string and through the screen into a formation surrounding the borehole.

16. The method as claimed in claim 15 wherein the injecting includes urging the one or more first members to the second operational position with the treatment fluid.

17. The method as claimed in claim 16 wherein the method further includes ceasing injection resulting in the one or more first members assuming the first operational position.

18. The method as claimed in claim 15 wherein the treatment fluid is a sand slurry and the one or more first members in the second operational position exclude particulates from fluid flowing through the opening in one direction only.

19. The method as claimed in claim 18 wherein the sand component of the slurry is excluded only during fluid flow direction returning to the tubing string after being injected into the formation.

* * * * *